US008371892B2

(12) United States Patent
Wei et al.

(10) Patent No.: US 8,371,892 B2
(45) Date of Patent: Feb. 12, 2013

(54) METHOD FOR MAKING ELECTRON EMISSION APPARATUS

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/470,482

(22) Filed: May 14, 2012

(65) Prior Publication Data

US 2012/0220182 A1 Aug. 30, 2012

Related U.S. Application Data

(62) Division of application No. 12/313,938, filed on Nov. 26, 2008, now Pat. No. 8,237,344.

(30) Foreign Application Priority Data

Feb. 1, 2008 (CN) ..... 2008 1 0066047

(51) Int. Cl.
*H01J 9/12* (2006.01)
*H01J 9/04* (2006.01)

(52) U.S. Cl. ..... 445/50; 445/49; 445/51; 445/23; 445/24; 313/307; 313/309; 313/310; 313/495; 313/496

(58) Field of Classification Search ..... 445/50, 445/49, 51, 22, 23, 24; 313/307, 309, 310, 313/495–497
See application file for complete search history.

(56) References Cited

U.S. PATENT DOCUMENTS

| | | | | |
|---|---|---|---|---|
| 6,472,814 | B1 * | 10/2002 | Yamanobe et al. | 313/495 |
| 6,486,599 | B2 * | 11/2002 | Wang et al. | 313/495 |
| 6,541,906 | B2 * | 4/2003 | Lee et al. | 313/495 |
| 6,628,053 | B1 * | 9/2003 | Den et al. | 313/310 |
| 6,672,925 | B2 * | 1/2004 | Talin et al. | 445/49 |
| 6,719,602 | B2 * | 4/2004 | Nakayama et al. | 445/50 |
| 6,812,635 | B2 * | 11/2004 | Cho et al. | 313/495 |
| 6,979,244 | B2 * | 12/2005 | Den et al. | 445/24 |
| 7,045,108 | B2 * | 5/2006 | Jiang et al. | 423/447.2 |
| 7,064,474 | B2 * | 6/2006 | Liu et al. | 313/309 |
| 7,102,157 | B2 * | 9/2006 | Kastalsky et al. | 257/40 |
| 7,129,626 | B2 * | 10/2006 | Kastalsky et al. | 313/309 |
| 7,276,389 | B2 * | 10/2007 | Kim et al. | 438/34 |
| 7,332,736 | B2 * | 2/2008 | Jin | 257/10 |
| 7,453,193 | B2 * | 11/2008 | Den et al. | 313/309 |
| 7,465,210 | B2 * | 12/2008 | Kim et al. | 445/46 |
| 7,471,039 | B2 * | 12/2008 | Lin et al. | 313/497 |

(Continued)

FOREIGN PATENT DOCUMENTS

| | | |
|---|---|---|
| JP | 2002-157951 | 5/2002 |
| JP | 2003-288837 | 10/2003 |

(Continued)

*Primary Examiner* — Nimeshkumar Patel
*Assistant Examiner* — Thomas A Hollweg
(74) *Attorney, Agent, or Firm* — Altis Law Group, Inc.

(57) ABSTRACT

A method for making the electron emission apparatus is provided. In the method, an insulating substrate including a surface is provided. A number of grids are formed on the insulating substrate and defined by a plurality of electrodes. A number of conductive linear structures are fabricated and supported by the electrodes. The number of conductive linear structures are substantially parallel to the surface and each of the grids contains at least one of the conductive linear structures. The conductive linear structures are cut to form a number of electron emitters. Each of the electron emitters has two electron emission ends defining a gap therebetween.

9 Claims, 11 Drawing Sheets

U.S. PATENT DOCUMENTS

2002/0060514 A1* 5/2002 Nakamoto ..... 313/311
2002/0134978 A1* 9/2002 Kastalsky et al. ..... 257/10
2003/0186625 A1* 10/2003 Nakayama et al. ..... 451/28
2004/0053432 A1* 3/2004 Liu et al. ..... 438/40
2004/0067602 A1* 4/2004 Jin ..... 438/22
2004/0095050 A1* 5/2004 Liu et al. ..... 313/309
2005/0244326 A1* 11/2005 Colbert et al. ..... 423/447.1
2005/0266766 A1* 12/2005 Wei et al. ..... 445/50
2006/0238105 A1* 10/2006 Lin et al. ..... 313/496
2007/0144780 A1 6/2007 Jiang et al.
2007/0166223 A1* 7/2007 Jiang et al. ..... 423/447.1
2007/0237952 A1* 10/2007 Jiang et al. ..... 428/367
2007/0296322 A1* 12/2007 Liu et al. ..... 313/311
2008/0012466 A1* 1/2008 Yang et al. ..... 313/495
2008/0122335 A1* 5/2008 Liu et al. ..... 313/292
2008/0170982 A1* 7/2008 Zhang et al. ..... 423/447.3
2008/0287030 A1* 11/2008 Kim et al. ..... 445/46

FOREIGN PATENT DOCUMENTS

JP 2007-128892 5/2007

* cited by examiner

METHOD FOR MAKING ELECTRON EMISSION APPARATUS

CROSS-REFERENCE TO RELATED APPLICATIONS

This application is a division application of U.S. patent application Ser. No. 12/313,938, filed on Nov. 26, 2008, entitled "ELECTRON EMISSION APPARATUS AND METHOD FOR MAKING THE SAME", which claims all benefits accruing under 35 U.S.C. §119 from China Patent Application No. 200810066047.2, filed on Feb. 1, 2008, in the China Intellectual Property Office, the contents of which are hereby incorporated by reference. This application is related to commonly-assigned applications entitled, "ELECTRON EMISSION APPARATUS AND METHOD FOR MAKING THE SAME", filed on Nov. 26, 2008, application Ser. No. 12/313,934; "METHOD FOR MAKING FIELD EMISSION ELECTRON SOURCE", filed on Nov. 26, 2008, application Ser. No. 12/313,937; "CARBON NANOTUBE NEEDLE AND THE METHOD FOR MAKING THE SAME", filed on Nov. 26, 2008, application Ser. No. 12/313,935; and "FIELD EMISSION ELECTRON SOURCE", filed on Nov. 26, 2008, application Ser. No. 12/313,932. The disclosures of the above-identified applications are incorporated herein by reference.

BACKGROUND

1. Technical Field

The present disclosure relates to electron emission apparatuses and methods for making the same and, particularly, to a carbon nanotube based electron emission apparatus and a method for making the same.

2. Description of Related Art

Many electron emission apparatuses include field emission displays (FEDs) and surface-conduction electron-emitter displays (SEDs). The electron emission apparatus can emit electrons via a quantum tunnel effect, which is opposite to a thermal excitation effect, and is of great interest for use in developing greater brightness and low power consumption of emission apparatus.

Referring to FIG. 9, a field emission device 300, according to the prior art, includes an insulating substrate 302, a number of electron emission units 310, cathode electrodes 308, and gate electrodes 304. The electron emission units 310, cathode electrodes 308, and gate electrodes 304 are located on the insulating substrate 302. The cathode electrodes 308 and the gate electrodes 304 cross each other to form a plurality of crossover regions. A plurality of insulating layers 306 is arranged corresponding to the crossover regions. Each electron emission unit 310 includes at least one electron emitter 312. The electron emitter 312 is in electrical contact with the cathode electrode 308 and spaced from the gate electrode 304. When receiving a voltage that exceeds a threshold value, the electron emitter 312 emits electron beams towards an anode. The luminance is adjusted by altering the applied voltage. However, the distance between the gate electrode 304 and the cathode electrode 308 is uncontrollable. As a result, the driving voltage is relatively high, thereby increasing the overall operational cost.

Referring to FIG. 10 and FIG. 11, a surface-conduction electron-emitter device, according to the prior art, 400 includes an insulating substrate 402, a number of electron emission units 408, cathode electrodes 406, and gate electrodes 404 located on the insulating substrate 402. Each gate electrode 404 includes a plurality of interval-setting prolongations 4042. The cathode electrodes 406 and the gate electrodes 404 cross each other to form a plurality of crossover regions. The cathode electrodes 406 and the gate electrodes 404 are insulated by a number of insulating layers 412. Each electron emission unit 408 includes at least one electron emitter 410. The electron emitter 410 is in electrical contact with the cathode electrode 406 and the prolongation 4042. The electron emitter 410 includes an electron emission portion. The electron emission portion is a film including a plurality of small particles. When a voltage is applied between the cathode electrode 406 and the prolongation 4042, the electron emission portion emits electron beams towards an anode. However, because the space between the particles in the electron emission portion is small and the anode voltage cannot be applied to the inner portion of the electron emission, the efficiency of the surface-conduction electron-emitter device 400 is relatively low.

What is needed, therefore, is to provide a highly-efficient electron emission apparatus with a simple structure.

BRIEF DESCRIPTION OF THE DRAWINGS

Many aspects of the present electron emission apparatus and method for making the same can be better understood with reference to the following drawings. The components in the drawings are not necessarily drawn to scale, the emphasis instead being placed upon clearly illustrating the principles of the present electron emission apparatus and method for making the same.

Figure 1:
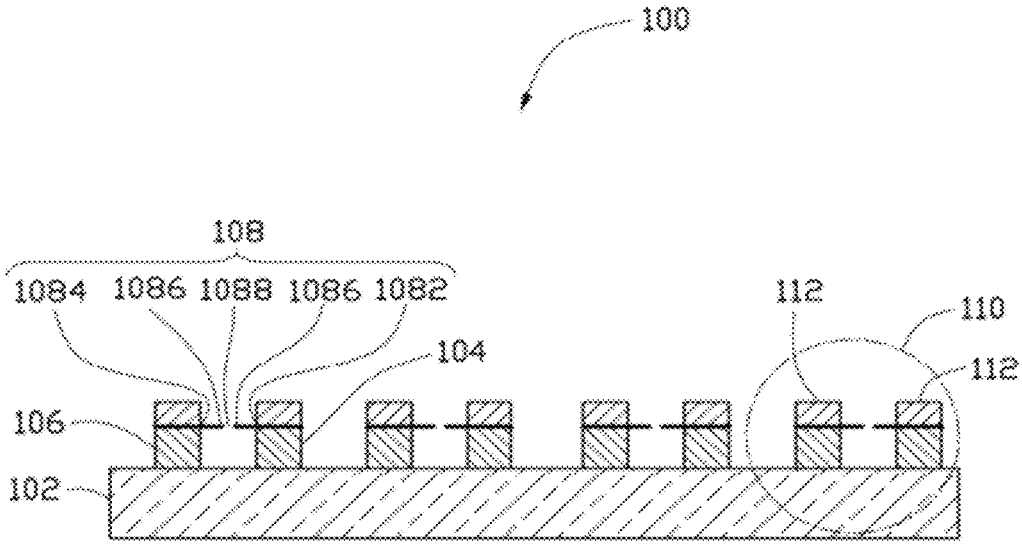
FIG. 1 is a schematic side view of an electron emission apparatus in accordance with an exemplary embodiment.

Corresponding reference characters indicate corresponding parts throughout the several views. The exemplifications set out herein illustrate at least one embodiment of the present electron emission apparatus and method for making the same, in at least one form, and such exemplifications are not to be construed as limiting the scope of the disclosure in any manner.

DETAILED DESCRIPTION

References will now be made to the drawings to describe, in detail, embodiments of the present electron emission device and method for making the same.

Figure 2:
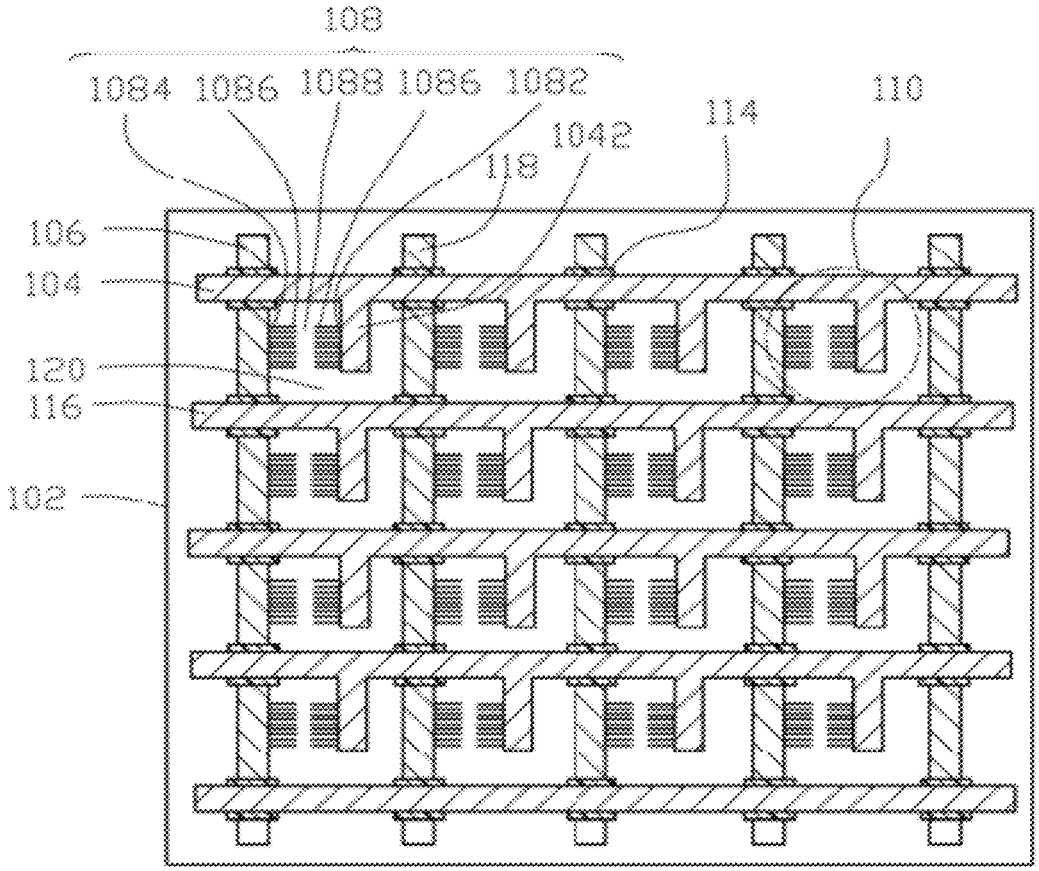
FIG. 2 is a schematic top view of the electron emission apparatus of FIG. 1.

Referring to FIG. 1 and FIG. 2, an electron emission apparatus 100 includes an insulating substrate 102, one or more electron emission units 110, grids 120, and pluralities of first electrodes 104, second electrodes 116, third electrodes 106 and fourth electrodes 118. The electron emission units 110, grids 120, first electrodes 104, second electrodes 116, third electrodes 106, and fourth electrodes 118 are located on the insulating substrate 102. Each electron emission unit 110 is located in one grid 120. The first electrodes 104, second electrodes 116, third electrodes 106, and fourth electrodes 118 are located on the periphery of the grid 120. The first electrodes 104 and the second electrodes 116 are parallel to each other, and the third electrodes 106 and the fourth electrodes 118 are parallel to each other. Furthermore, a plurality of insulating layers 114 are sandwiched between the electrodes 104, 106, 116, 118 at the intersections thereof, to avoid short circuits.

The insulating substrate 102 can be made of glass, ceramics, resin, or quartz. In this embodiment, the insulating substrate 102 is made of glass. A thickness of the insulating substrate 102 is determined according to user-specific needs.

The first electrodes 104, second electrodes 116, third electrodes 106, and fourth electrodes 118 are made of conductive material. A distance between each first electrode 104 and each second electrode 116 approximately ranges from 100 microns to 1000 microns. A distance between each third electrode 106 and each fourth electrode 118 approximately ranges from 100 microns to 1000 microns. The first electrodes 104, second electrodes 116, third electrodes 106, and fourth electrodes 118 each have a width approximately ranging from 30 microns to 200 microns and a thickness approximately ranging from 10 microns to 50 microns. Each first electrode 104 includes a plurality of prolongations 1042 parallel to each other. The prolongations 1042 are connected to the first electrodes 104. A space between the adjacent prolongations 1042 approximately ranges from 100 microns to 1000 microns. A shape of the prolongations 1042 is determined according to user-specific needs. In this embodiment, the first electrodes 104, second electrodes 116, third electrodes 106, and fourth electrodes 118 are strip-shaped planar conductors formed by a screen-printing method. The length of each prolongation 1042 is approximately 100 microns to 900 microns, the width of each prolongation 1042 is approximately 30 microns to 200 microns and a thickness of each prolongation 1042 is approximately 10 microns to 50 microns.

The first electrode 104, second electrode 116, third electrode 106 and fourth electrode 118 form a grid 120. While in one grid the second electrode 116 is in fact the second electrode 116, in an adjacent grid that same electrode will act as a first electrode 104 for the adjacent grid. The same is true for all of the electrodes that help define more than one grid.

Each electron emission unit 110 includes at least one electron emitter 108. The electron emitters 108 each include a first end 1082, a second end 1084, and a gap 1088. The first end 1082 is electrically connected to one of the plurality of the first electrodes 104 or the second electrodes 116, and the second end 1084 is electrically connected to one of the plurality of the third electrodes 106 or the fourth electrodes 118. The first end 1082 is opposite to the second end 1084. Two electron emission ends 1086 are located beside the gap 1088, and each electron emission end 1086 includes one electron emission tip. The width of the gap 1088 approximately ranges from 1 micron to 20 microns. The electron emission end 1086 and the electron emission tip are each cone-shaped and the diameter of the electron emission end 1086 is smaller than the diameter of the electron emitter 108. When receiving a voltage between the first electrodes 104 (or second electrodes 116) and the third electrodes 106 (or fourth electrodes 118), the electron emission ends 1086 of the electron emitters 108 can easily emit electron beams, thereby improving the electron emission efficiency of the electron emission apparatus 100. The electron emitters 108 comprise a conductive linear structure and can be selected from a group consisting of metal wires, carbon fiber wires, and carbon nanotube wires.

The electron emitters 108 in each electron emission unit 110 are uniformly spaced. Each electron emitter 108 is arranged substantially perpendicular to the third electrode 106 or the fourth electrode 118 of each grid 120.

In the present embodiment, each electron emitter 108 comprises a carbon nanotube wire. A diameter of the carbon nanotube wire approximately ranges from 0.1 microns to 20 microns, and a length of the carbon nanotube wire approximately ranges from 50 microns to 1000 microns. Each carbon nanotube wire includes a plurality of continuously oriented and substantially parallel-arranged carbon nanotube segments joined end-to-end by van der Waals attractive force. Furthermore, each carbon nanotube segment includes a plurality of substantially parallel-arranged carbon nanotubes, wherein the carbon nanotubes have an approximately the same length and are substantially parallel to each other.

The carbon nanotubes of the carbon nanotube wire can be selected from a group comprising of single-wall carbon nanotubes, double-wall carbon nanotubes, multi-wall carbon nanotubes, and any combination thereof. A diameter of the carbon nanotubes approximately ranges from 0.5 nanometers to 50 nanometers.

Figure 3:
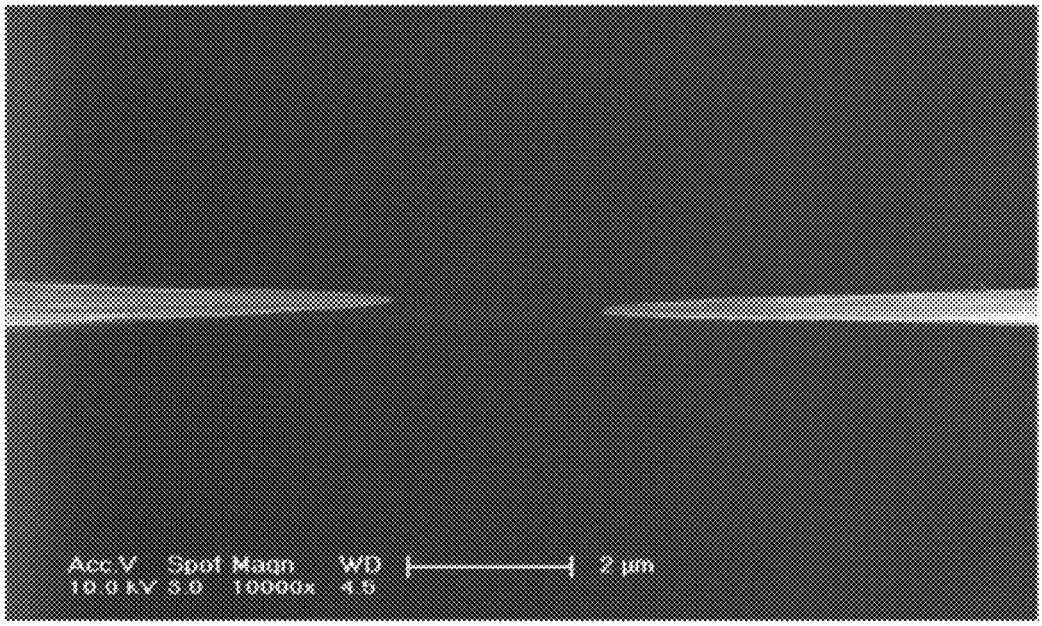
FIG. 3 shows a Scanning Electron Microscope (SEM) image of an electron emission tip of a carbon nanotube wire used in the electron emission apparatus of FIG. 1.
Figure 4:
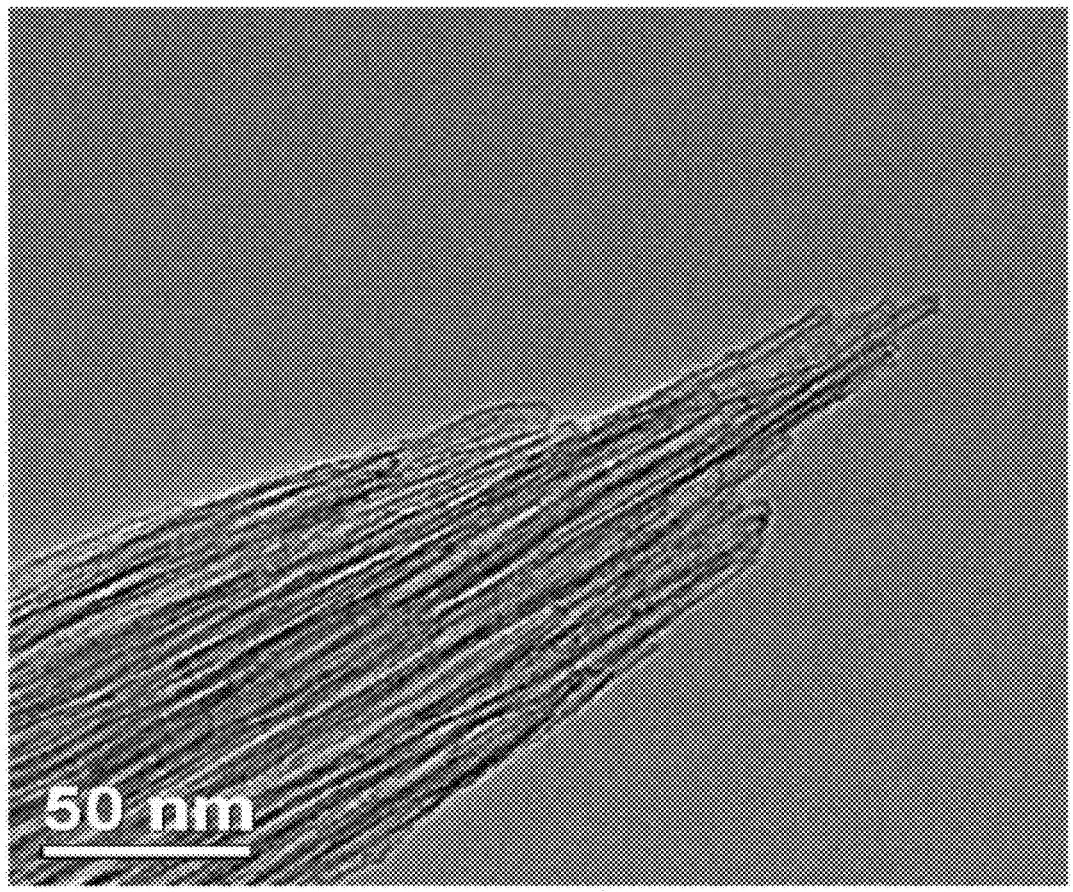
FIG. 4 shows a Transmission Electron Microscope (TEM) image of the electron emission tip of FIG. 3.

Referring to FIG. 3 and FIG. 4, the electron emission end of the carbon nanotube wire includes one electron emission tip. Each electron emission tip includes a plurality of substantially parallel-arranged carbon nanotubes. The carbon nanotubes are combined with each other by van der Waals attractive force. One carbon nanotube extends from the substantially parallel carbon nanotubes in each electron emission tip.

The electron emission apparatus 100 further includes a plurality of fixed elements 112 located on the tops of the electrodes 104, 106, 116, 118. The fixed elements 112 are used for fixing the electron emitters 108 on the electrodes 104, 106, 116, 118. The electron emitters 108 are sandwiched by the fixed elements 112 and the electrodes 104, 106, 116, 118. The material of the fixed element 112 is determined according to user-specific needs. When the prolongations 1042 are formed, the fixed elements 112 are formed on the top of the prolongations 1042.

Figure 5:
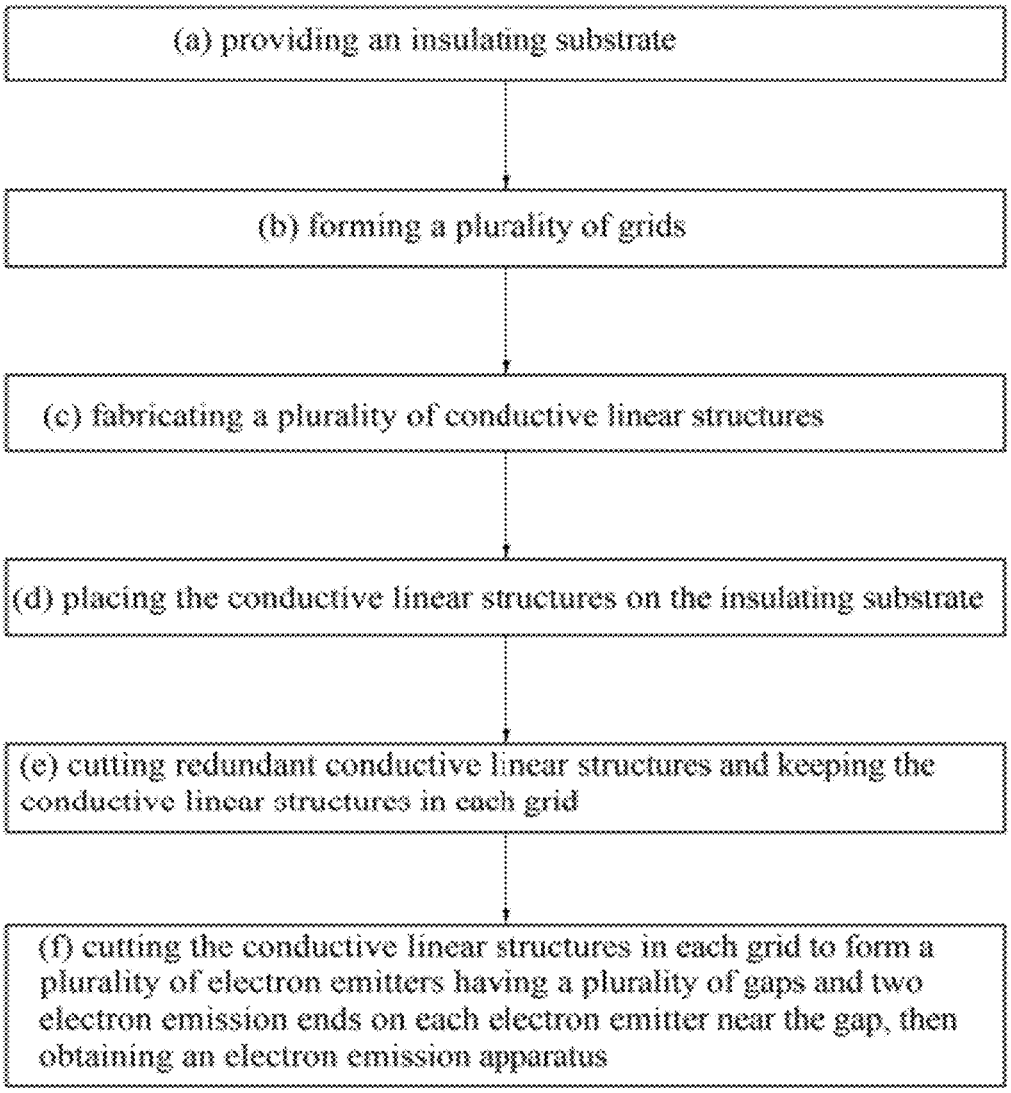
FIG. 5 is a flow chart of a method for making an electron emission apparatus in accordance with an exemplary embodiment.

Referring to FIG. 5 and FIG. 2, a method for making the electron emission apparatus 100 includes the following steps: (a) providing an insulating substrate 102 (e.g., a glass substrate); (b) forming a plurality of grids 120 defined by first electrodes 104, second electrodes 116, third electrodes 106, and fourth electrodes 118; (c) fabricating conductive linear structures supported by the electrodes 104, 116, 106, 118; (d) cutting redundant conductive linear structures and keeping the conductive linear structures in each grid 120, the cutting can be done with a laser; and (e) cutting the conductive linear structures in each grid to form a plurality of electron emitters 108 having a plurality of gaps 1088 and two electron emission ends 1086 on each electron emitter 108 near the gap 1088, then obtaining an electron emission apparatus 100.

In step (b), the grids 120 can be formed by the following substeps: (b1) forming a plurality of uniformly-spaced first electrodes 104 and second electrodes 116 parallel to each other on the insulating substrate 102 by a method of screen-printing; (b2) forming a plurality of insulating layers 114 at the crossover regions between the first electrodes 104, the second electrodes 116, the third electrodes 106, and the fourth electrodes 118 by the method of screen-printing; (b3) forming a plurality of uniformly-spaced third electrodes 106 and fourth electrodes 118 parallel to each other on the insulating substrate 102 by the method of screen-printing. The first electrodes 104 and the second electrodes 116 are insulated from the third electrodes 106 and the fourth electrodes 118 by the insulating layer 114 at the crossover regions thereof. The first electrodes 104 and the second electrodes 116, and the third electrodes 106 and the fourth electrodes 118 can be respectively and electrically connected together by a connections external of the gird 120. Additionally a plurality of prolongations 1042 of first electrodes 104 can be formed parallel to each other and the third electrodes 106. The prolongations 1042 are electrically connected to the first electrodes 104.

In step (b1), a conductive paste is printed on the insulating substrate 102 by the method of screen-printing to form the first electrodes 104 and the second electrodes 116. The conductive paste includes metal powder, low-melting frit, and organic binder. A mass ratio of the metal powder in the conductive paste approximately ranges from 50% to 90%. A mass ratio of the low-melting glass powder in the conductive paste approximately ranges from 2% to 10%. A mass ratio of the binder in the conductive paste approximately ranges from 10% to 40%. In this embodiment, the metal powder is silver powder and binder is terpilenol or ethylcellulose.

In step (c), the conductive linear structures can be metal wires, carbon nanofiber wires, or carbon nanotube wires. The conductive linear structures are substantially parallel to each other. The carbon nanotubes wire can be fabricated by the following substeps: (c1) providing an array of carbon nanotubes; (c2) pulling out a carbon nanotube structure from the array of carbon nanotubes via a pulling tool (e.g., adhesive tape, pliers, tweezers, or another tool allowing multiple carbon nanotubes to be gripped and pulled simultaneously), the carbon nanotube structure is a carbon nanotube film or a carbon nanotube yarn; (c3) placing the carbon nanotube structure on the electrodes 104, 106, 116, 118; (c4) treating the carbon nanotube structure with an organic solvent to form one or several carbon nanotube wires, and thereby fabricating at least one conductive linear structure supported by the electrodes 104, 106, 116, 118.

In step (c1), a given super-aligned array of carbon nanotubes can be formed by the following substeps: (c11) providing a substantially flat and smooth substrate; (c12) forming a catalyst layer on the substrate; (c13) annealing the substrate with the catalyst at a temperature approximately ranging from 700° C. to 900° C. in air for about 30 minutes to 90 minutes; (c14) heating the substrate with the catalyst at a temperature approximately ranging from 500° C. to 740° C. in a furnace with a protective gas therein; and (c15) supplying a carbon source gas into the furnace for about 5 minutes to 30 minutes and growing a super-aligned array of the carbon nanotubes from the substrate.

In step (c11), the substrate can be a p-type silicon wafer, an n-type silicon wafer, or a silicon wafer with a film of silicon dioxide thereon. A 4-inch p-type silicon wafer is used as the substrate.

In step (c12), the catalyst can be made of iron (Fe), cobalt (Co), nickel (Ni), or any alloy thereof.

In step (c14), the protective gas can be made up of at least one of the following gases: nitrogen ($N_2$), ammonia ($NH_3$), and a noble gas. In step (b15), the carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can be approximately 200 microns to 400 microns in height and includes a plurality of carbon nanotubes parallel to each other and substantially perpendicular to the substrate. The super-aligned array of carbon nanotubes formed under the above conditions is essentially free of impurities, such as carbonaceous or residual catalyst particles. The carbon nanotubes in the super-aligned array are packed together closely by van der Waals attractive force.

In step (c2), the carbon nanotube structure can be pulled out from the super-aligned array of carbon nanotubes by the following substeps: (c21) selecting a number of carbon nanotube segments having a predetermined width from the array of carbon nanotubes; and (c22) pulling the carbon nanotube segments at an even/uniform speed to form the carbon nanotube structure.

In step (c21), the carbon nanotube segments having a predetermined width can be selected by using a wide adhesive tape as the tool to contact the super-aligned array. Each carbon nanotube segment includes a plurality of carbon nanotubes parallel to each other, and combined by van der Waals attractive force therebetween. The carbon nanotube segments can vary in width, thickness, uniformity, and shape. In step (c22), the pulling direction can be arbitrary (e.g., substantially perpendicular to the growing direction of the super-aligned array of carbon nanotubes).

More specifically, during the pulling process, as the initial carbon nanotube segments are drawn out, other carbon nanotube segments are also drawn out end-to-end due to the van der Waals attractive force between ends of adjacent carbon nanotube segments. This process of drawing ensures a continuous, uniform carbon nanotube structure can be formed. The carbon nanotubes of the carbon nanotube structure are all substantially parallel to the pulling direction, and the carbon nanotube structure produced in such manner have a selectable, predetermined width.

The width of the carbon nanotube structure (i.e., carbon nanotube film or yarn) depends on the size of the carbon nanotube array. The length of the carbon nanotube structure is determined according to a practical application. In this embodiment, when the size of the substrate is 4 inches, the width of the carbon nanotube structure is in the approximate range from 0.05 nanometers to 10 centimeters, and the thickness of the carbon nanotube structure approximately ranges from 0.01 microns to 100 microns. It is to be understood that, when the width of the carbon nanotube structure is relatively narrow, the carbon nanotube structure is in the form of yarn; when the width of the carbon nanotube structure is relatively wide, the carbon nanotube structure is in the form of film.

In step (c3), at least one carbon nanotube structure is placed between the first electrodes 104 and the third electrodes 106, between the first electrodes 104 and the fourth electrodes 118, between the second electrodes 116 and the third electrodes 106, and between the second electrodes 116 and the fourth electrodes 118. When the prolongations 1042 are formed, the carbon nanotube structure can be placed between the third electrodes 106 (or the fourth electrodes 118) and the prolongations 1042, and connected to the first electrodes 104 (or the second electrodes 116) by the prolongations 1042. Before the carbon nanotube structures are arranged, the electrodes 104, 106, 116, 118 are coated with conductive adhesive so that the carbon nanotube structures can be firmly fixed thereon. A plurality of fixed electrodes 112 can also be screen-printed on the electrodes 104, 106, 116, 118. It is to be understood that, when the carbon nanotube structure is carbon nanotube film, the carbon nanotube film can be placed on the substrate 102 and entirely covers the electrodes on the substrate 102, aligned along a direction from the third and fourth electrodes 106, 118 to the first and second electrodes 116.

Figure 7:
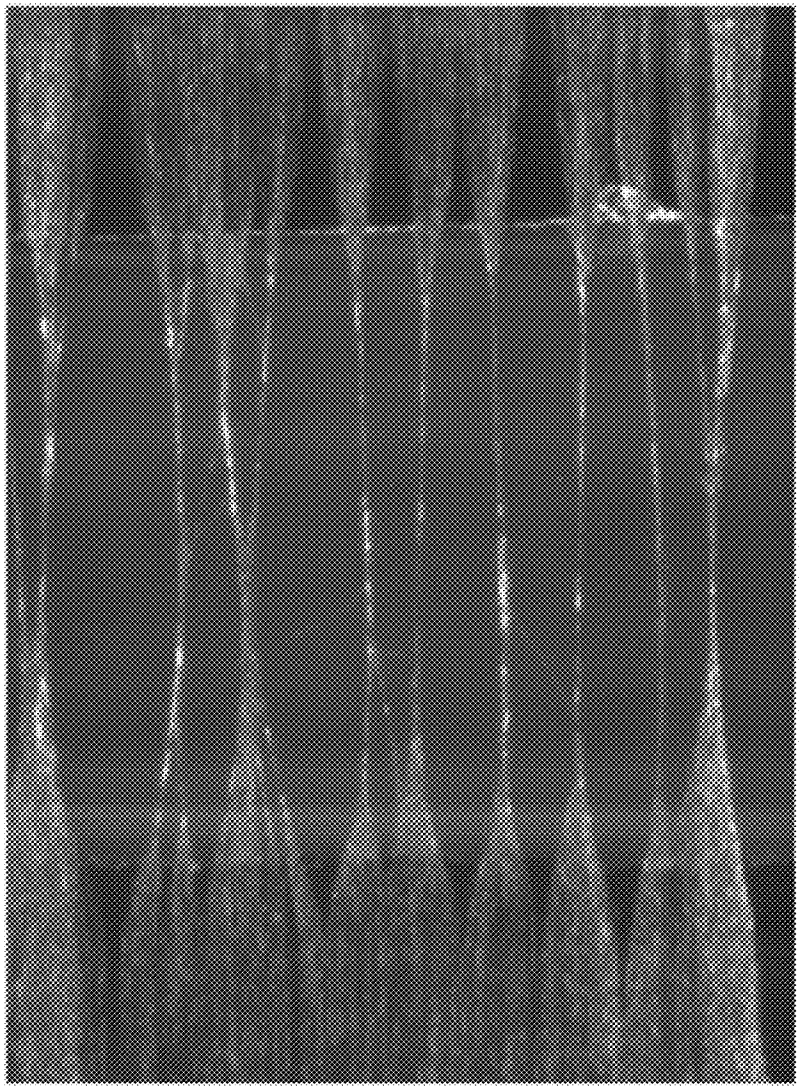
FIG. 7 shows an SEM image of a carbon nanotube structure treated by an organic solvent.

In step (c4), the carbon nanotube structure can be soaked in an organic solvent. Since the untreated carbon nanotube structure is composed of a number of carbon nanotubes, the untreated carbon nanotube structure has a high surface area to volume ratio and thus may easily become stuck to other objects. Referring to FIG. 7, during the surface treatment, the carbon nanotube structure is shrunk into one or several carbon nanotube wires after the organic solvent volatilizing process, due to factors such as surface tension. There are a plurality of wedged portions having narrow ends connected with the one or several carbon nanotube wires and wide ends opposite to the narrow ends in the treated carbon nanotube structure. The surface-area-to-volume ratio and diameter of the treated carbon nanotube wire is reduced. Accordingly, the stickiness of the carbon nanotube structure is lowered or eliminated, and strength and toughness of the carbon nanotube structure is improved. The organic solvent may be a volatilizable organic solvent at room temperature, such as ethanol, methanol, acetone, dichloroethane, chloroform, and any combination thereof.

In step (e), via the cutting step, the conductive linear structures are broken to form two electron emission ends 1086, and as such, a gap 1088 is formed therebetween. The position of the gap 1088 in each conductive linear structure can be controlled. In the present embodiment, the method of cutting the conductive linear structures is performed in a vacuum or an atmosphere of inert gases, where a voltage is applied between the first electrodes 104 (or second electrodes 116) and the third electrodes 106 (or fourth electrodes 118). Thus, the conductive linear structures on the insulating substrate 102 along a direction from the first electrodes 104 (or second electrodes 116) to the third electrodes 106 (or fourth electrodes 118) are heated to separate. The cutting step can also be performed by laser ablation or electron beam scanning. In the separated position, two electron emission ends 1086 are formed. In this embodiment, the conductive linear structures comprise carbon nanotube wires. A temperature of heating the carbon nanotube wires approximately ranges from 2000 to 2800 K. A time of heating the carbon nanotube wires approximately ranges from 20 minutes to 60 minutes.

Figure 6:
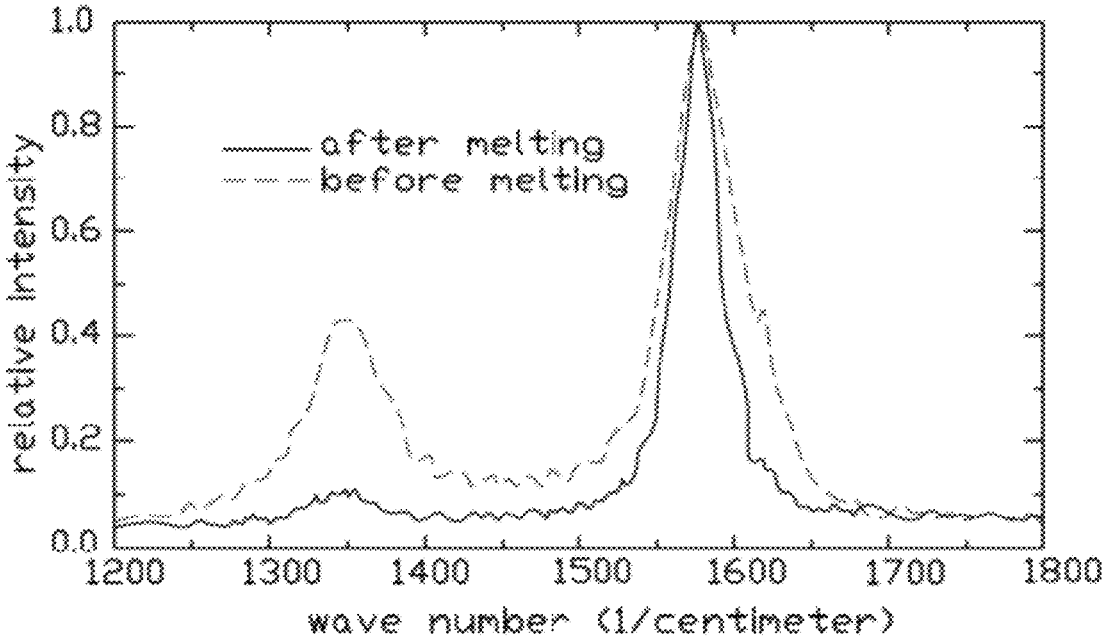
FIG. 6 shows a Raman spectroscopy of the electron emission tip of FIG. 3.

Referring to FIG. 6, after the carbon nanotube wire is heated (i.e., melted), defects of the electron emission tip thereof are decreased, thereby improving the quality of the carbon nanotubes in the electron emission tip.

Figure 8:
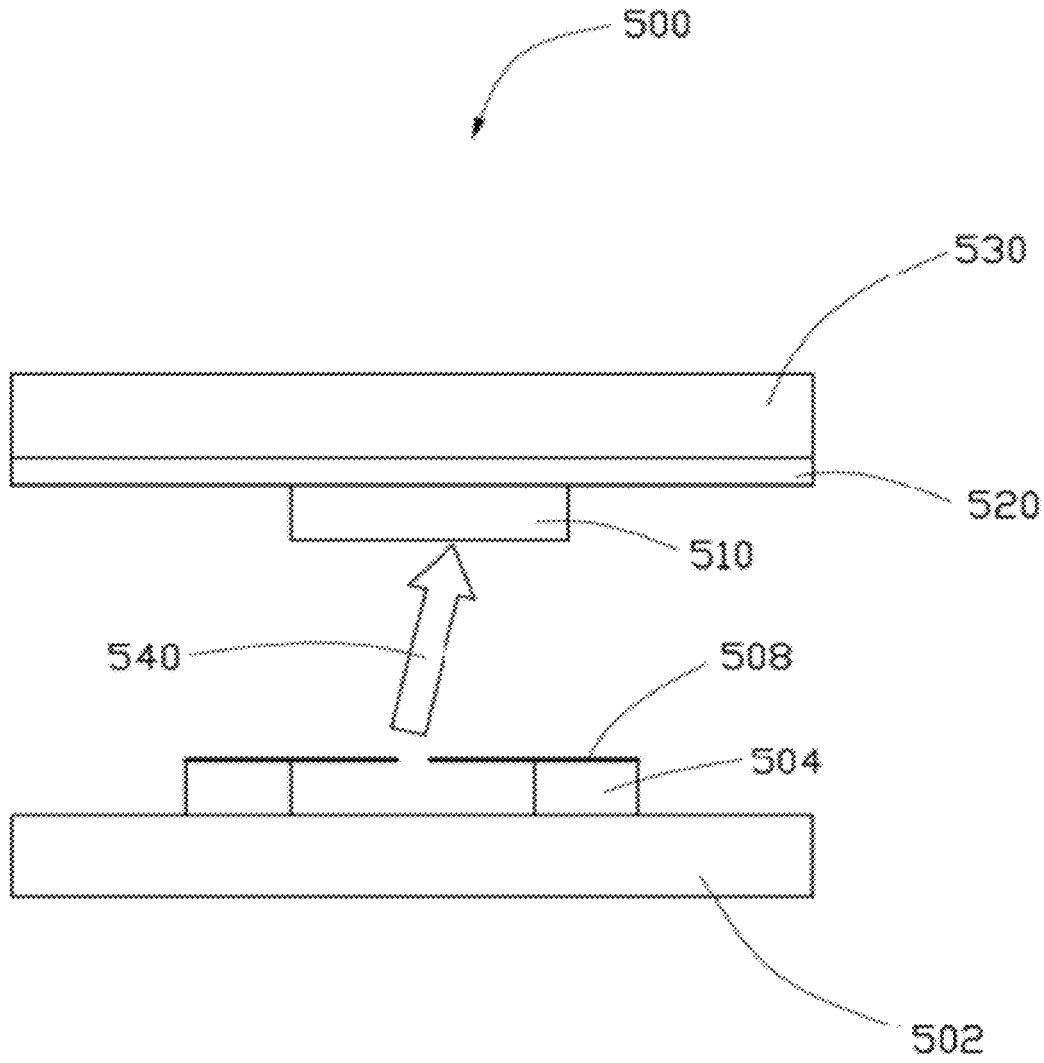
FIG. 8 is a schematic side view of a field emission display.
Figure 9:
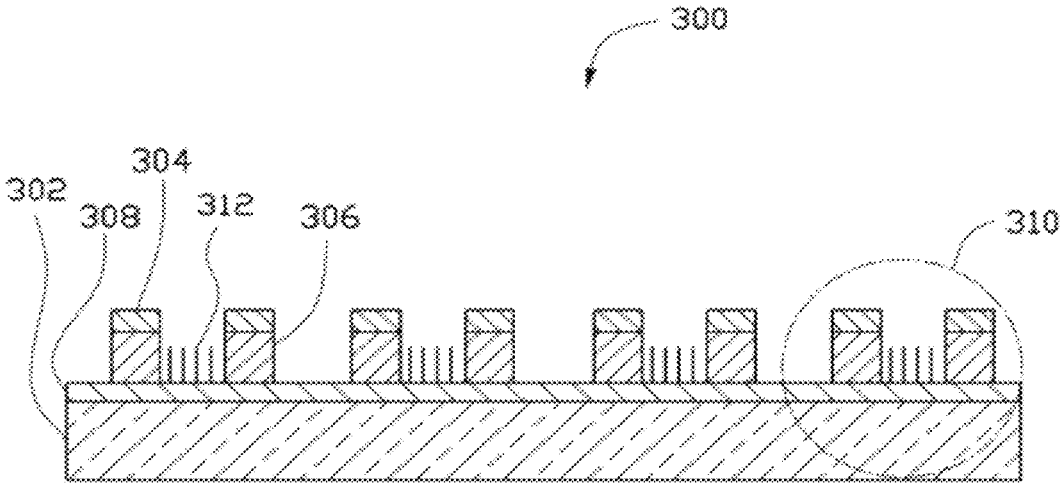
FIG. 9 (PRIOR ART)
FIG. 9 is a schematic side view of a conventional field emission device according to the prior art.
Figure 10:
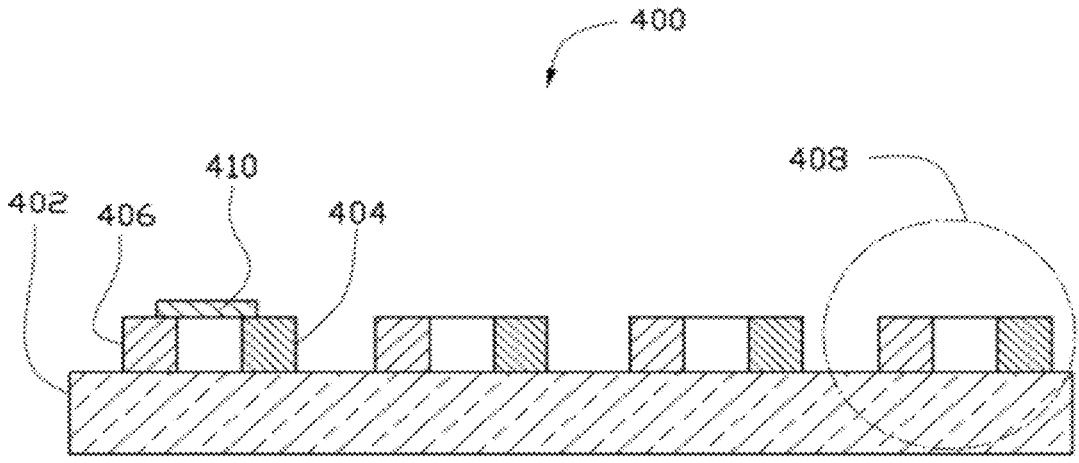
FIG. 10 (PRIOR ART)
FIG. 10 is a schematic side view of a conventional surface-conduction electron-emitter device according to the prior art.
Figure 11:
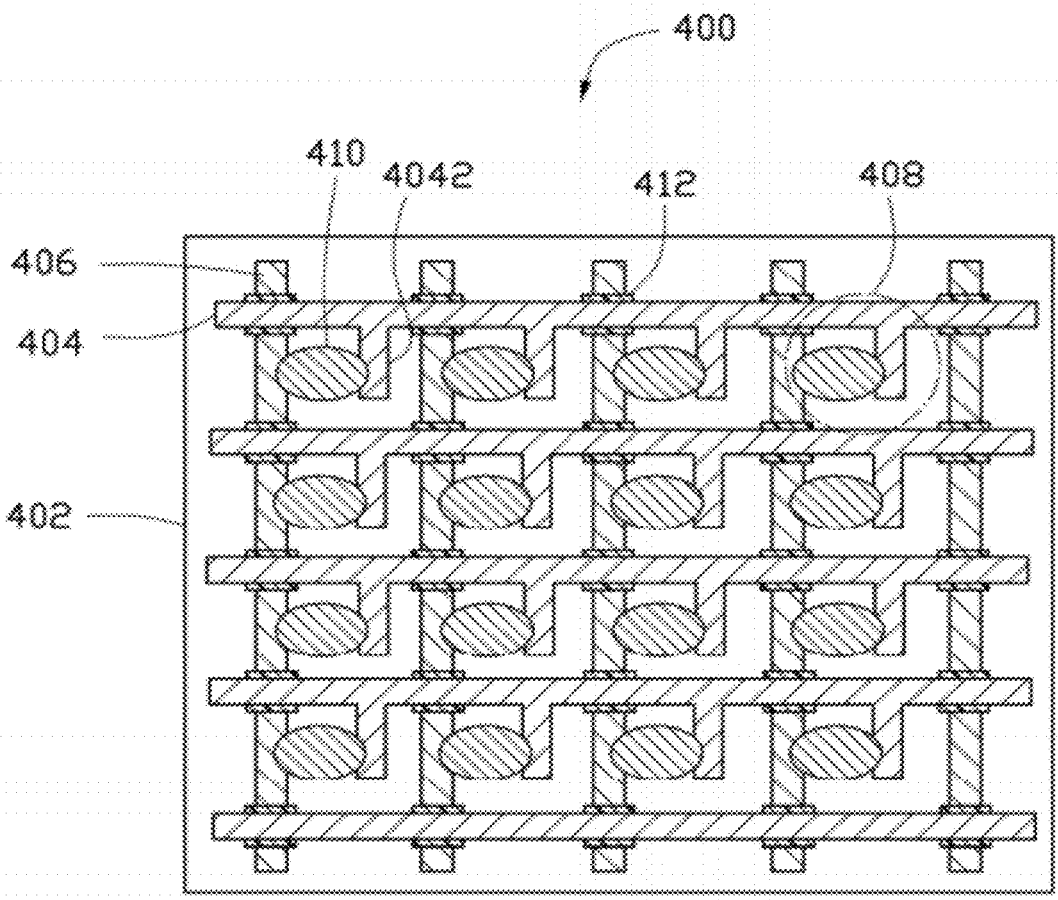
FIG. 11 (PRIOR ART)
FIG. 11 is a schematic top view of the conventional surface-conduction electron-emitter device of FIG. 10.

Referring to FIG. 8, the electron emission apparatus can be used in an electron emission display 500. The electron emission display 500 includes an anode substrate 530 facing the cathode substrate 502, an anode layer 520 formed on the lower surface of the anode substrate 530, an phosphor layer 510 formed on the anode layer 520, an electron emission apparatus facing the anode substrate 530. The electron emission apparatus includes a plurality of electrodes 504 and electron emitters 508 formed on and supported by the tops of the electrodes 504. In use, voltage differences are applied between the electrodes 504 and the anode layer 520, thus, electrons 540 are emitted from the electron emitters 508 and to the anode layer 520.

Compared to other electron emission apparatus, the present electron emission apparatus 100 has the following advantages: (1) the structure of the electron emission apparatus 100 is simple, wherein the first electrodes 104, second electrodes 116, third electrodes 106, fourth electrodes 108, and the electron emitters 108 are coplanar; (2) each electron emitter 108 includes a gap 1088, the electron emission end 1086 of the electron emitter 108 can easily emit the electrons by applying a voltage between the first electrode 104 and the third electrode 106, thereby improving the electron emission efficiency of the electron emission apparatus 100.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

It is also to be understood that the description and the claims may include some indication in reference to certain steps. However, the indication used is applied for identification purposes only, and the identification should not be viewed as a suggestion as to the order of the steps.

What is claimed is:

1. A method for making the electron emission apparatus, the method comprising:

(a) providing an insulating substrate having a surface;

(b) forming a plurality of grids on the insulating substrate defined by a plurality of electrodes;

(c) fabricating a plurality of conductive linear structures supported by the plurality of electrodes, the plurality of conductive linear structures being substantially parallel to the surface and each of the plurality of grids contains at least one of the plurality of conductive linear structures; and (d) cutting the plurality of conductive linear structures to form a plurality of electron emitters, each of the plurality of electron emitters having two electron emission ends defining a gap therebetween;

wherein in step (c), each of the plurality of conductive linear structures comprises at least one carbon nanotube wire, and the step (c) further comprises:

(c1) providing an array of carbon nanotubes;

(c2) pulling out a carbon nanotube structure from the array of carbon nanotubes, the carbon nanotube structure being a carbon nanotube film or a carbon nanotube yarn;

(c3) placing the carbon nanotube structure on the insulating substrate supported by the plurality of electrodes; and (c4) treating the carbon nanotube structure with an organic solvent to form one or more carbon nanotube wires.

2. The method of claim 1, wherein in step (d) the plurality of conductive linear structures are cut by laser ablation, electron beam scanning, or vacuum melting.

3. The method of claim 2, wherein the plurality of conductive linear structures are cut by the vacuum melting method that comprises:

applying a voltage between two ends of each of the plurality of conductive linear structures in a vacuum or an inert gases environment to heat the plurality of conductive linear structures.

4. The method of claim 3, wherein each of the plurality of conductive linear structures is heated for about 20 minutes to about 60 minutes to a temperature of about 2000K to about 2800K to melt the each of the plurality of conductive linear structures.

5. The method of claim 1, wherein in step (b), the plurality of electrodes comprise a plurality of first electrodes, second electrodes, third electrodes, and fourth electrodes, and the plurality of grids are formed by:

(b1) forming the plurality of uniformly-spaced first electrodes and second electrodes parallel to each other on the insulating substrate;

(b2) fabricating a plurality of insulating layers; and (b3) placing the plurality of third electrodes and the plurality of fourth electrodes on the insulating substrate;

wherein the plurality of third electrodes and the plurality of fourth electrodes are uniformly-spaced, parallel to each other, and intersect the plurality of uniformly-spaced first electrodes and second electrodes at intersecting regions, the plurality of insulating layers insulate the plurality of uniformly-spaced first electrodes and second electrodes from the plurality of uniformly-spaced third electrodes and fourth electrodes at the intersecting regions.

6. The method of claim 5, wherein the step (b) further comprises a step of adding a first electrode prolongation connected to one of the plurality of uniformly-spaced first electrodes, and adding a second electrode prolongation connected to one of the plurality of uniformly-spaced second electrodes.

7. The method of claim 6, wherein the first electrode prolongation and the second electrode prolongation are parallel to the plurality of uniformly-spaced third electrodes and fourth electrodes.

8. The method of claim 6, wherein the at least one of the plurality of conductive linear structures in each of the plurality of grids has two ends respectively connected to one of the first and second electrode prolongations and one of the plurality of uniformly-spaced third electrodes and fourth electrodes.

9. The method of claim 8 further comprising a step of fixing the plurality of conductive linear structure by forming a plurality of fixed electrodes at the two ends of the plurality of conductive linear structures.

* * * * *